United States Patent [19]

Gilvar et al.

[11] Patent Number: 4,706,485

[45] Date of Patent: Nov. 17, 1987

[54] CARRIER MODULE

[75] Inventors: Martin Gilvar, Oakham; Harold E. Woodrow, Northboro; Camille S. Nasrah, Worcester, all of Mass.

[73] Assignee: Morgan Construction Company, Worcester, Mass.

[21] Appl. No.: 941,324

[22] Filed: Dec. 15, 1986

[51] Int. Cl.[4] ..... B21B 27/10; B21B 31/08; B21B 39/16

[52] U.S. Cl. ..... 72/239; 72/45; 72/201; 72/236; 72/238; 72/250

[58] Field of Search ..... 72/239, 238, 237, 236, 72/250, 41–45, 201

[56] References Cited

U.S. PATENT DOCUMENTS

| | | | |
|---|---|---|---|
| 1,813,592 | 7/1931 | Wadsten | 72/236 |
| 3,646,790 | 3/1972 | Properzi | 72/236 X |
| 4,581,911 | 4/1986 | Shinomoto | 72/237 X |
| 4,653,304 | 3/1987 | Feldmann et al. | 72/239 |

*Primary Examiner*—Robert L. Spruill
*Assistant Examiner*—Steve Katz
*Attorney, Agent, or Firm*—Samuels, Gauthier Stevens & Kehoe

[57] ABSTRACT

A portable carrier module for transporting work rolls and entry and exit guides to and from a cantilevered roll stand in a rolling mill. The carrier module remains removably mounted on the roll stand during the rolling operation, and includes integral roll cooling means automatically coupled to water supply conduits extending through the roll stand housing.

10 Claims, 4 Drawing Figures

CARRIER MODULE

BACKGROUND OF THE INVENTION

1. Field of the Invention

This invention relates generally to cantilevered roll stands for rolling mills, and is concerned in particular with a means of facilitating a rapid and efficient exchange of work rolls and guides for such roll stands.

2. Description of the Prior Art

In the interest of achieving the highest possible production efficiencies, rolling mill operators constantly strive to minimize the time during which the mill must be shut down to allow for the replacement of worn components. This is particularly true of the work rolls and guides of cantilevered roll stands. These components must be replaced at relatively frequent intervals, and thus considerable importance is attached to the rapidity with which operating personnel can effect such replacements.

A primary objective of the present invention is the provision of a means for simultaneously exhanging one set of worn work rolls and guides for another replacement set, without having to transport and install such components individually.

Another and related object of the present invention is to permit a replacement set of work rolls and guides to be preliminarily assembled and adjusted at a location away from the rolling line, e.g., in the roll shop, while rolling continues without interruption with another set of work rolls and guides already installed at the rolling line.

Still another objective of the present invention is to minimize disturbances to the roll cooling system during a roll and guide changing operation.

SUMMARY OF THE INVENTION

In a preferred embodiment of the invention, these and other objects and advantages are realized in connection with the rapid replacement of the work rolls and guides of a cantilevered roll stand, the latter including a conventional housing with externally protruding roll shafts ends. A portable carrier module includes a module plate having a roll shaft opening and pairs of roll engaging arms arranged on opposite sides of a module reference line. The module plate has supports on which entry and exit guides are removably clamped in alignment with the module reference line. The roll engaging arms are pivotally adjustable between open and closed positions. When in the closed positions, the arms are adapted to engage and temporarily support work rolls on opposite sides of the module reference line and in alignment with the roll shaft opening.

The module plate is adapted to be detachably secured to the roll stand housing, with the module reference line aligned concentrically with the mill pass line, and with the roll shafts protruding axially through the roll shaft opening in the module plate and through the work rolls temporarily supported in alignment therewith by the closed roll engaging arms. The roll engaging arms may then be adjusted to their open positions in spaced relationship with the work rolls, thus permitting the work rolls to be detachably secured on the roll shafts by conventional roll mounting means.

Preferably, adjustment mechanisms are provided for symmetrically and simultaneously adjusting each pair of roll engaging arms between their respective open and closed positions.

Advantageously, the carrier module includes intermediate water conduits which are automatically coupled to water supply conduits in the roll stand housing when the carrier module is mounted thereon. The intermediate conduits communicate with orifices arranged on the roll engaging arms to spray cooling water on the work rolls during the rolling operation.

These and other objects and advantages of the invention will be described in more detail with reference to the accompanying drawings, wherein:

DETAILED DESCRIPTION OF ILLUSTRATED EMBODIMENT

Figure 1:
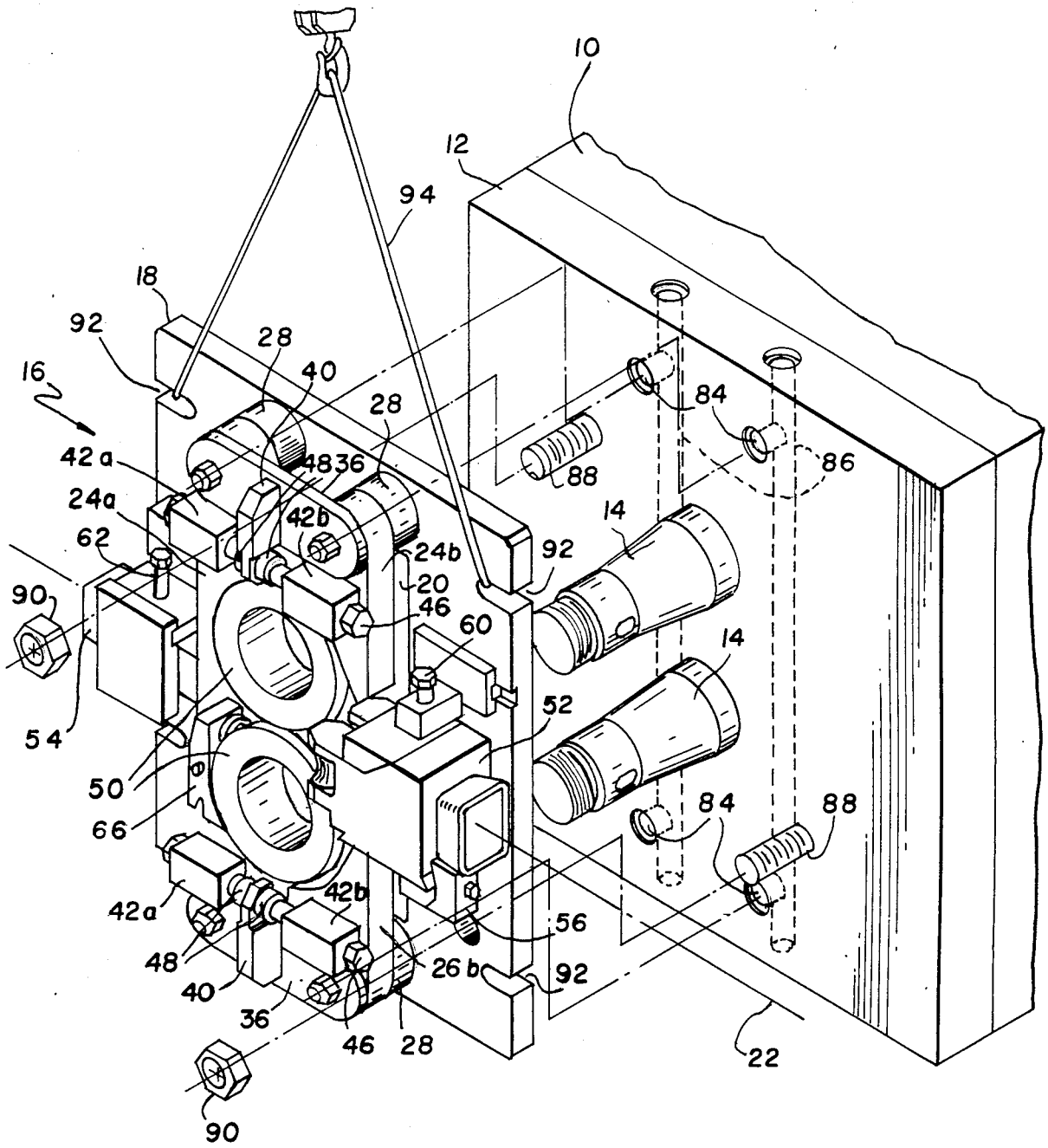
FIG. 1 is a three dimensional view showing a carrier module in accordance with the present invention in the process of being mounted on the housing of a cantilevered roll stand.

Referring now to the drawings, a cantilevered roll stand housing is partially illustrated at 10 as including a face plate 12 with a pair of roll shafts 14 protruding axially therefrom. Although not shown, it will be understood by those skilled in the art that the housing includes conventional gearing and/or spindles for driving the roll shafts, as well as conventional roll parting adjustment mechanisms, all as shown for example in U.S Pat. No. Re. 28,107 issued on Aug. 6, 1974. the disclosure of which is herein incorporated by reference.

The carrier module 16 of the present invention includes a module plate 18 having a large rectangular roll shaft opening 20 generally bisected by module reference line 22. Upper and lower pairs of roll engaging arms 24*a*, 24*b* and 26*a*, 26*b* are pivotally mounted to the module plate on opposite sides of the module reference line 22.

Figure 3:
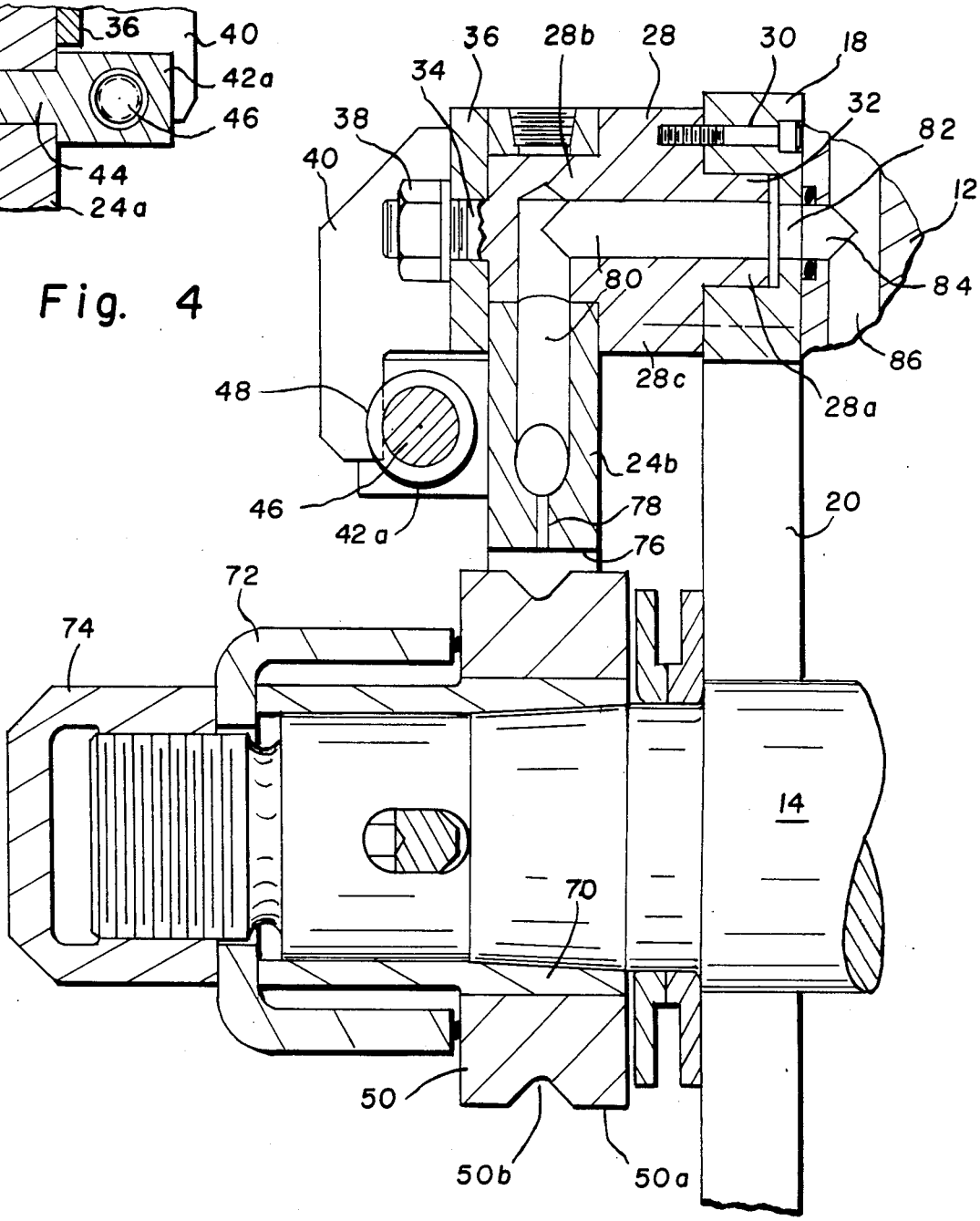
FIG. 3 is a sectional view on an enlarged scale taken along line 3—3 of FIG. 2.

FIG. 3 is representative of how each roll engaging arm is mounted to the module plate 18. A stub shaft 28 has inner and outer reduced diameter portions 28*a*, 28*b* axially separated by a larger diameter barrel portion 28*c*. The stub shaft is held in place on the module plate 18 by a machine screw 30 threaded into the barrel portion 28*c*, with the inner portion 28*a* being received in a bore 32 in the module plate 18, and with the outer portion 28*b* extending through an opening in the arm 24*b*. The outer portion terminates in a threaded stud 34 which extends through a keeper plate 36 held in place by a nut 38 threaded onto the stud.

Figure 4:
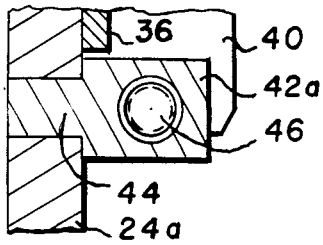
FIG. 4 is another sectional view taken along line 4—4 of FIG. 2.

A single keeper plate 36 is common to each pair of roll engaging arms, and each keeper plate includes an intermediate rib 40. The roll engaging arms of each pair are respectively provided with right and left hand nut members 42*a*, 42*b*. As can best be seen in FIG. 4, each nut member has a lateral cylindrical extension 44 rotatably received in a bore in the respective roll engaging arm. A spindle 46 is associated with each pair of roll engaging arms. Each spindle has shoulders 48 arranged on opposite sides of the rib 40, and right and left hand threaded portions respectively threaded through the right and left hand nut members 42*a*, 42*b*. Rotation of each spindle thus causes the associated pair of roll engaging arms to be symmetrically adjusted with respect to each other about the axes of their respective stub shafts 28, with axial movement of the spindle being opposed by engagement of its shoulders 48 with the rib 40 of the associated keeper plate 36.

The module is adapted to carry a pair of work rolls 50, and entry and exit guides 52,54. The work rolls are of the conventional type, each having a cylindrical surface 50*a* interrupted by at least one roll groove 50*b*.

The module plate 18 has guide supports 56,58 on which the entry and exit guides 52,54 are respectively removably mounted in alignment with the module reference line 22 by means of retaining bolts 60,62, the latter being carried on brackets also attached to the module plate.

The roll engaging arms 24*b*, 26*b* are each provided with buttons 64. The roll engaging arms 24*a*, 26*a* carry rocker members 66, the latter in turn each being provided with a button 64 and a shoulder 68. When the roll engaging arms are adjusted to their closed positions as shown in the lower portion of FIG. 2, the buttons 64 are seated in the roll groove 50*b*, and the shoulder 68 extends across the roll groove in contact with the cylindrical roll surface 50*a*, thereby temporarily supporting the roll in a position to axially receive a roll shaft end 14.

Figure 2:
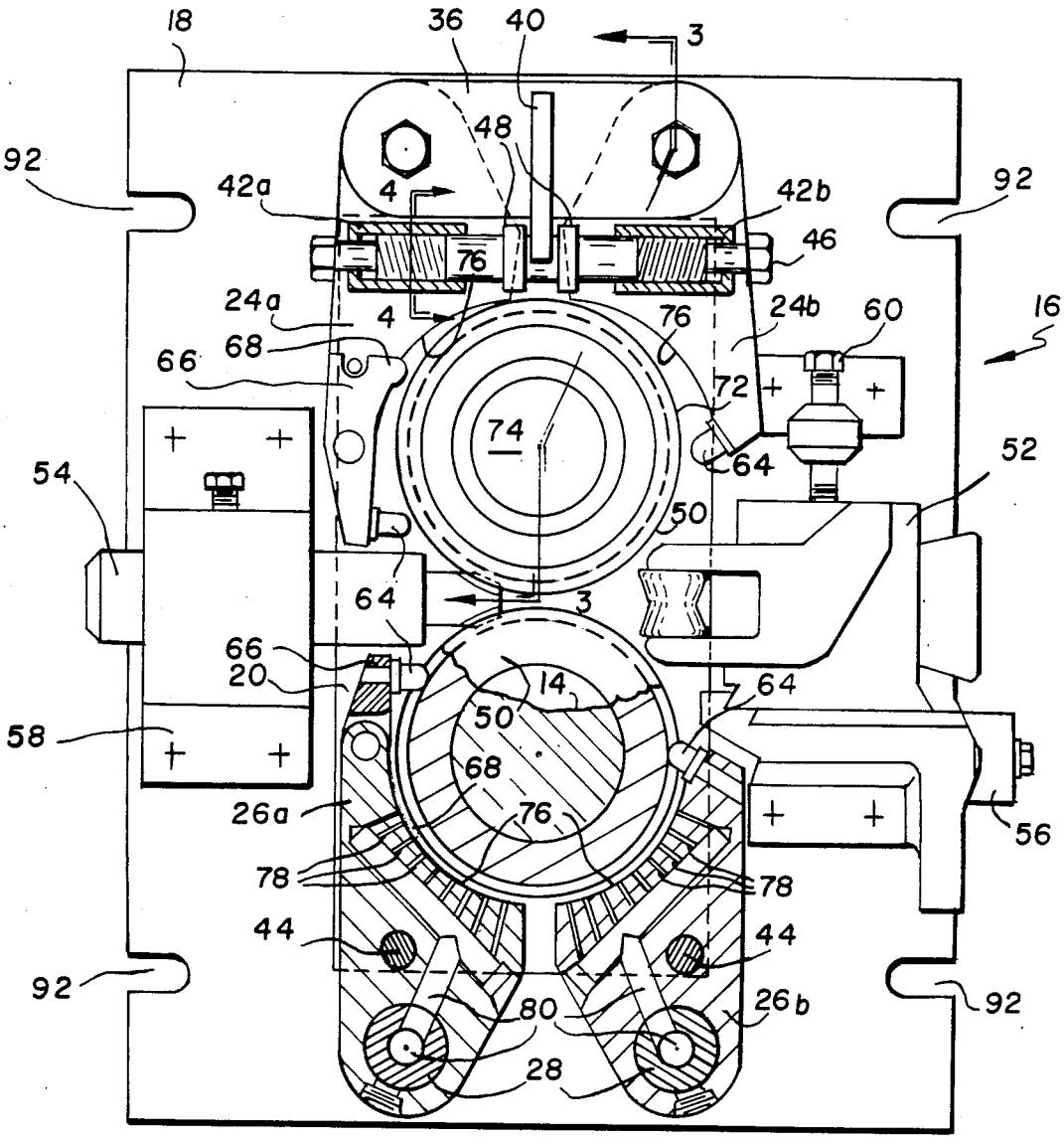
FIG. 2 is a front view of the carrier module, with the upper roll engaging arms shown in the open position spaced from a work roll removably mounted on its respective roll shaft, and with the lower roll engaging arms in the closed position temporarily supporting a work roll prior to its being released for mounting on its respective roll shaft.

When the roll engaging arms are adjusted to the open position as shown in the upper portion of FIG. 2, the buttons 64 and shoulder 68 are spaced from the work roll, thereby allowing the roll to be removably secured to the roll shaft by any conventional means, such as for example, the tapered sleeve 70, cover 72 and threaded cap 74 shown in FIG. 3.

The roll engaging arms are each provided with curved interior surfaces 76 arranged to partially surround the work rolls. Spray orifices indicated typically at 78 are spaced along the surfaces 76. The orifices 78 are connected by intermediate passageways 80 leading through the roll engaging arms and their respective stub shafts 28 to ports 82 in the rear face of the module plate 18.

When the module plate is removably secured to the roll stand housing, the ports 82 are aligned with ports 84 in the housing face plate 12. The ports 84 lead to passageways 86 which may be connected by any conventional means (not shown) to a source of pressurized cooling liquid, typically water. The carrier module may be removably mounted on the roll stand by any convenient means, one example being the threaded studs 88 and nuts 90 shown in FIG. 1. When thus mounted, the module reference line 22 is automatically aligned concentrically with the mill pass line.

It is contemplated that one carrier module with its work rolls 50 and entry and exit guides 52,54 will remain installed on the roll stand during rolling, while a spare set of work rolls and guides are being assembled and pre-aligned on another carrier module at a location remote from the rolling line. When roll and guide replacement is required, one carrier module can be rapidly substituted for the other, with a minimum loss of valuable production time. The module plates 18 are provided with side notches 92 which can be engaged by a lifting cable 94, thereby enabling the module to be conveniently carried from one location to another by an overhead crane or other like means.

We claim:

1. In a rolling mill, a carrier module for the work rolls and guides of a cantilevered roll stand, said mill stand having a housing with externally protruding roll shafts on which the work rolls are removably secured on opposite sides of a mill pass line, with the guides serving to direct a product along the mill pass line between the work rolls, said carrier module comprising: a module plate having a roll shaft opening generally bisected by a module reference line; roll engaging arms mounted on said module plate on opposite sides of said reference line, said arms being adjustable between closed positions engaging and temporarily locating the work rolls on opposite sides of said reference line and in alignment with said roll shaft opening, and open positions retracted from said closed positions; support means for detachably securing the guides to said module plate in alignment with said module reference line; and mounting means for detachably securing said module plate to said housing with said reference line aligned concentrically with the mill pass line and with said roll shafts protruding through said roll shaft opening and the work rolls engaged and temporarily located by said arms, whereupon adjustment of said arms to their open positions will cause said arms to move away from said work rolls, thereby enabling said work rolls to be removably secured to their respective roll shafts.

2. The carrier module of claim 1 wherein said roll engaging arms are pivotally attached to said module plate.

3. The carrier module of claim 2 further comprising adjustment means for simultaneously adjusting each pair of roll engaging arms between their respective open and closed positions.

4. The carrier module of claim 3 wherein the arms of each of said pairs are provided respectively with right and left hand nut members threaded onto right and left hand threaded portions of a common rotatable spindle, and wherein means are provided for opposing axial movement of said spindle during rotation thereof to simultaneously adjust said arms between their open and closed positions.

5. The carrier mdoule of claim 1 further comprising orifices positioned on said arms to apply a liquid coolant to said work rolls during a rolling operation.

6. The carrier module of claim 5 further comprising first conduit means communicating with said orifices and extending through said arms and said module plate, and second conduit means communicating with a source of liquid coolant and extending through said housing, said first and second conduit means being arranged to be placed in mutual communication as a result of said module plate being detachably secured to said housing.

7. The carrier module of claims 5 or 6 wherein said arms are provided with partially circular interior surfaces surrounding portions of said work rolls, said orifices being arranged along said interior surfaces.

8. The carrier module of claim 1 wherein said work rolls are each provided with cylindrical surfaces interrupted by at least one circumferential groove, and wherein said arms are each provided with first protrusions suitably configured and dimensioned to fit into said grooves when said arms are in the closed positions.

9. The carrier module of claim 8 wherein at least one arm of each pair is provided with a second protrusion arranged to contact said cylindrical surface when said arms are in the closed positions.

10. The carrier module of claim 9 wherein a rocker member is pivotally supported on one arm of each pair, and wherein the first and second protrusions of the said one arm are carried on said rocker member.

* * * * *